US007084834B1

(12) United States Patent
Hopkins

(10) Patent No.: US 7,084,834 B1
(45) Date of Patent: Aug. 1, 2006

(54) MOUNTING ASSEMBLY FOR SECTORIZED ANTENNAS

(76) Inventor: Steven R. Hopkins, P.O. Box 7722, Incline Village, NV (US) 89452

( * ) Notice: Subject to any disclaimer, the term of this patent is extended or adjusted under 35 U.S.C. 154(b) by 0 days.

(21) Appl. No.: 11/076,368

(22) Filed: Mar. 8, 2005

Related U.S. Application Data

(60) Provisional application No. 60/551,085, filed on Mar. 8, 2004.

(51) Int. Cl.
*H01Q 1/12* (2006.01)

(52) U.S. Cl. ..... 343/878

(58) Field of Classification Search ..... 343/878, 343/882, 886, 888, 890, 892
See application file for complete search history.

(56) References Cited

U.S. PATENT DOCUMENTS 4,222,055 A * 9/1980 Hockham et al. ..... 343/762
5,353,337 A * 10/1994 Tsumura et al. ..... 379/93.08
5,608,414 A * 3/1997 Amore ..... 343/700 MS
6,222,504 B1 4/2001 Oby ..... 343/892
6,229,497 B1 * 5/2001 McCracken ..... 343/878
6,351,250 B1 * 2/2002 Gillen ..... 343/890
6,353,419 B1 * 3/2002 Gates et al. ..... 343/882
6,862,000 B1 * 3/2005 Desargant et al. ..... 343/840
6,982,680 B1 * 1/2006 Janoschka et al. ..... 343/878

* cited by examiner

*Primary Examiner*—Don Wong
*Assistant Examiner*—Huedung X. Cao
(74) *Attorney, Agent, or Firm*—Sierra Patent Group, Ltd.

(57) ABSTRACT

A mounting assembly for sectorized antennas comprising: a plurality of vertical mounting columns, each of said plurality of vertical mounting columns being configured to support an antenna; and a first horizontal bracket having a top surface and a perimeter, said perimeter being defined by an inner portion configured to be secured to a vertical support structure and an outer portion configured to support said plurality of vertical mounting columns, wherein said vertical mounting columns may not be rotated for azimuth adjustment, wherein said inner portion of said first horizontal bracket comprises a V-notch positioned substantially at the center of said inner portion, a first inner vertical surface integral with said first horizontal bracket, and a second inner vertical surface integral with said first horizontal bracket, and wherein said outer portion of said first horizontal bracket comprises at least one outer vertical surface integral with said first horizontal bracket.

20 Claims, 11 Drawing Sheets

MOUNTING ASSEMBLY FOR SECTORIZED ANTENNAS

CROSS-REFERENCE TO RELATED APPLICATIONS

This application claims priority to U.S. Provisional Application Ser. No. 60/551,085, filed Mar. 8, 2004, which is hereby incorporated by reference as if set forth herein.

BACKGROUND

1. Field of the Invention

The present invention relates to a mounting assembly for supporting a plurality of sectorized antennas on a support structure, such as a mast or wall.

2. The Prior Art

Prior art mounting assemblies for sectorized antennas have been limited in their design.

Many mounting assemblies are configured to attach only to a particular structure, either a wall or a mast, not both. Mounting assemblies designed for attachment to a mast are typically limited in the size of the mast they are able to accommodate. It is also common for mounting assemblies to be closed, requiring the installer to place the mount over the top of the mast and slide it down. This type of installation can be difficult if the mast is tall.

Prior art mounting assemblies also require several different parts that must be assembled by the user. Not only does this make installation more difficult, but it also complicates the manufacturing process and increases the cost of mass production.

Additionally, prior art mounting assemblies suffer from a heavy design, caused by excess material and the type of material being used. A heavy design makes it more difficult for a person to carry and can complicate the installation. It can also make the transport of the mounting assembly more difficult and increase shipping costs.

Prior art mounting assemblies also suffer from a structural design providing limited stability. Since most mounting assemblies comprise only one horizontal support level, each antenna is more susceptible to unwanted movement caused by wind, rain, and other external factors. This one level design also places a tremendous amount of stress on a small area of the mounting assembly, rather than spreading it out. Another disadvantage of having only one horizontal support level is that the attachment to a wall or mast is also based on only one level of support. Therefore, not only are the antennas provided with limited stability, but the actual mounting assembly itself is provided with limited stability as well.

Additionally, prior art mounting assemblies do not provide a convenient path for cables to be run directly to each antenna. This results in more cable being used for the indirect route and a disorganized grouping of cables, making it harder to identify and manipulate individual cables.

What is needed in the art is a mounting assembly for sectorized antennas that overcomes the deficiencies of the prior art.

SUMMARY

The present invention discloses a mounting assembly for sectorized antennas. The mounting assembly comprises a first plurality of vertical mounting columns, each of the first plurality of vertical mounting columns being configured to support an antenna, and a first horizontal bracket having a top surface and a perimeter, the perimeter being defined by an inner portion configured to be secured to a vertical support structure and an outer portion configured to support the first plurality of vertical mounting columns, wherein the first plurality of vertical mounting columns may not be rotated for azimuth adjustment of the antenna.

The inner portion of the first horizontal bracket comprises a V-notch positioned substantially at the center of the inner portion, a first inner vertical surface integral with the first horizontal bracket, and a second inner vertical surface integral with the first horizontal bracket, the first and second inner vertical surfaces being substantially perpendicular to the top surface and positioned on opposite sides of the V-notch, the first and second inner vertical surfaces comprising at least one bolt aperture and at least one banding aperture.

The outer portion of the first horizontal bracket comprises at least one outer vertical surface integral with the first horizontal bracket, the at least one outer vertical surface being substantially perpendicular to the top surface and comprising a plurality of apertures spaced horizontally from one another for supporting and making azimuth adjustments for the first plurality of vertical mounting columns.

It is an object of the present invention to provide a mounting assembly for sectorized antennas with a minimum of different parts to allow mass production methods to be used in manufacture.

It is yet another object of the present invention to provide a mounting assembly for sectorized antennas that can support differing numbers of sectorized antennas pointing at differing azimuths.

It is yet another object of the present invention to provide a mounting assembly for sectorized antennas that can easily be carried in its entirety by one person.

It is yet another object of the present invention to provide a mounting assembly for sectorized antennas that can be clamped to a small diameter mast.

It is yet another object of the present invention to provide a mounting assembly for sectorized antennas that provides a rigid structure.

It is yet another object of the present invention to provide a mounting assembly for sectorized antennas that can be attached to a large diameter mast with banding.

It is yet another object of the present invention to provide a mounting assembly for sectorized antennas that can be bolted to a wall.

It is yet another object of the present invention to provide a mast assembly that is weather-resistant.

It is yet another object of the present invention to provide a mounting assembly for sectorized antennas that breaks down for ease of shipping and storage.

It is yet another object of the present invention to provide a mounting assembly for sectorized antennas that is inexpensive to manufacture.

It is yet another object of the present invention to provide a mounting assembly for sectorized antennas that is light in weight for ease of installation and low cost of transport.

It is yet another object of the present invention to provide a mounting assembly for sectorized antennas whereby two groups of antennas covering 180 degrees each can be mounted on opposite sides of a tower.

It is yet another object of the present invention to provide a mounting assembly for sectorized antennas that provides cables with a convenient access path to each antenna.

DESCRIPTION OF THE DRAWINGS

FIG. 1A is a plan view of the second alternative mounting assembly banded to a large diameter mast.

DETAILED DESCRIPTION

Figure 1:
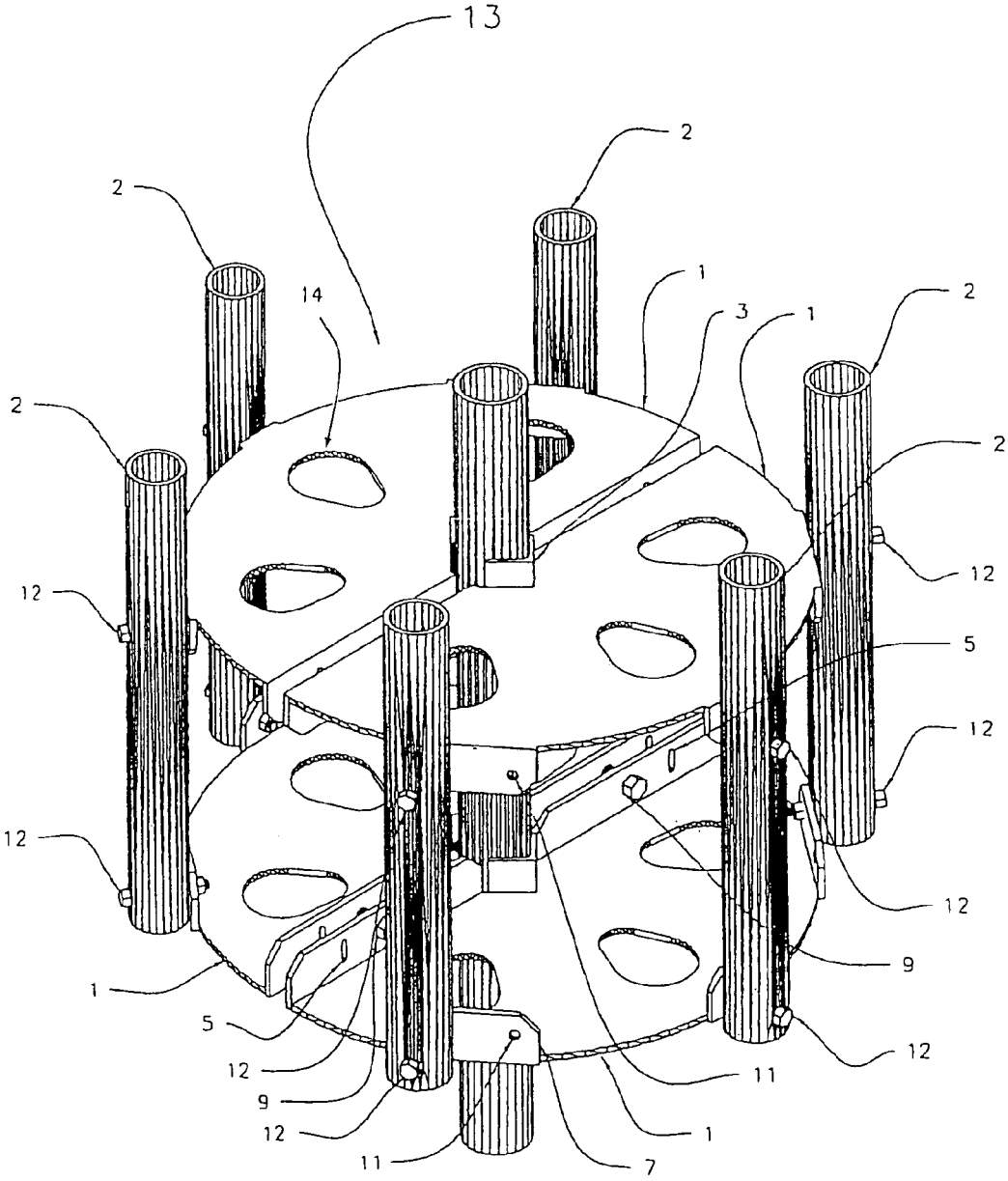
FIG. 1 is an oblique view of an exemplary embodiment of a mounting assembly for sectorized antennas clamped to a small diameter mast.

Persons of ordinary skill in the art will realize that the following disclosure is illustrative only and not in any way limiting. Other embodiments of the invention will readily suggest themselves to such skilled persons having the benefit of this disclosure.

In FIGS. 1 through 6B, an exemplary embodiment of a mounting assembly for sectorized antennas 13 is shown, wherein like elements are numbered alike. The mounting assembly 13 comprises four horizontal brackets 1 and six vertical mounting columns 2. As will be explained below, horizontal brackets 1 support vertical mounting columns 2 between horizontal brackets 1.

Horizontal brackets 1 may be made of aluminum that is cut, punched and formed by methods that are well known in the art. The use of aluminum contributes to the light weight of the present invention, making it easier to carry, transport and install, and ultimately less expensive to ship. Preferably, the type of aluminum used is easily formed and capable of supporting the other components. Other materials that may be used to form horizontal brackets 1 may include, but are not limited to, steel, sheet metal, composites, formed or molded plastic, sintered metal, and other suitable materials for mass manufacturing.

Each horizontal bracket 1 has a perimeter that is defined by an outer portion configured to support vertical mounting columns 2 and an inner portion configured to be mounted, clamped, banded, or otherwise secured to a stable support structure, such as a mast or a flat wall.

The inner portion of each horizontal bracket 1 comprises a V-notch 3 and at least two mounting tabs 6, with at least one mounting tab 6 being positioned on each side of V-notch 3. V-notch 3 allows horizontal brackets 1 to be secured to masts of various diameters when used in pairs. Since V-notch 3 is in a V-shape, there is no limit to the size of the mast to which horizontal brackets 1 may be secured. V-notch 3 may comprise a pair of engaging tabs 16 to provide a larger engagement surface for the mast. Engaging tabs 16 are substantially planar surfaces form V-notch 3. Engaging tabs 16 are substantially perpendicular to the top surface of horizontal bracket 1, thereby providing a vertical surface that distributes the clamping force on a mast and provides additional stability. In a preferred embodiment, engagement tabs 16 extend above and below horizontal bracket 1. However, it is contemplated that engagement tabs 16 may also extend only above or only below horizontal bracket 1.

Figure 4:
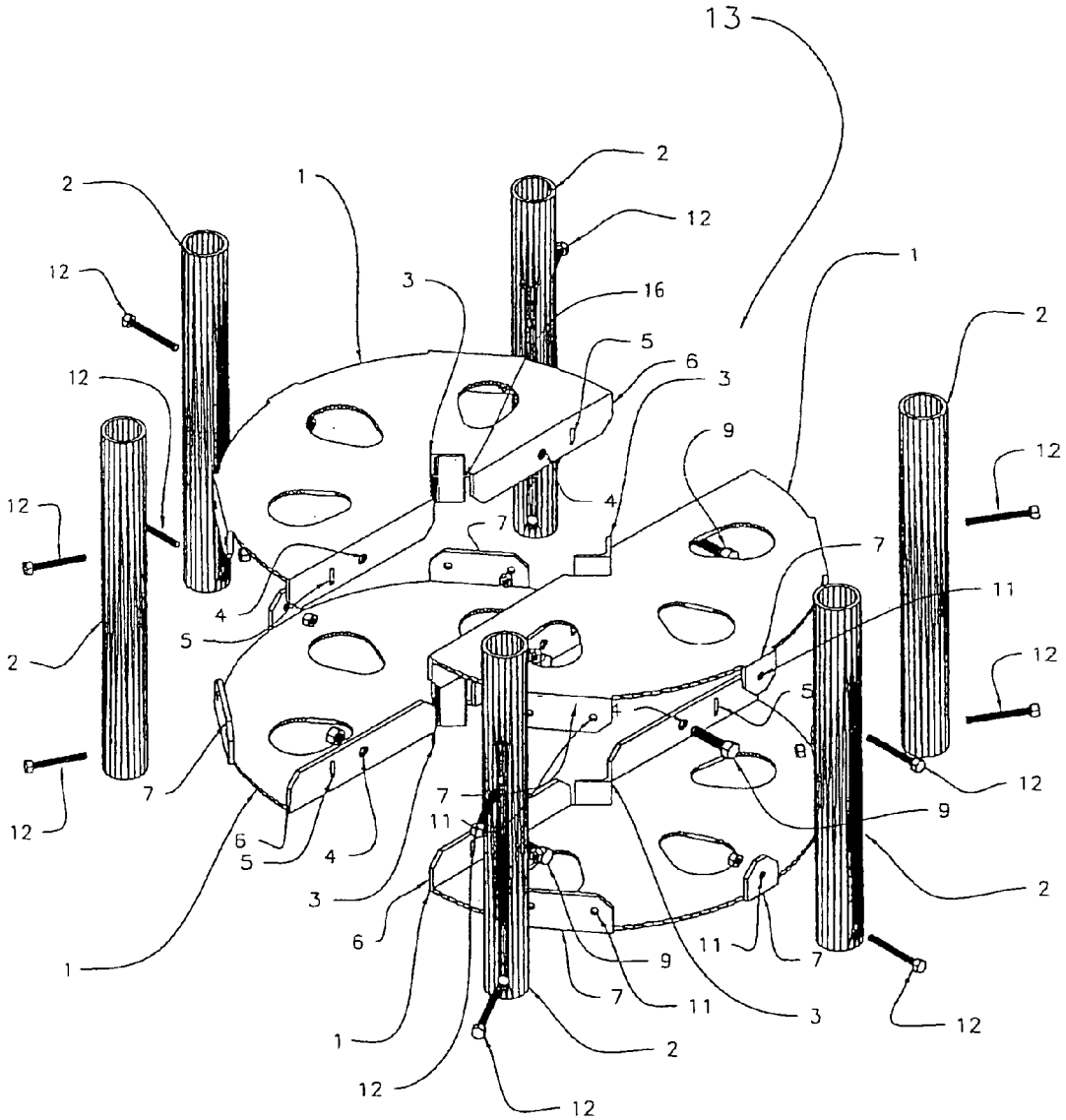
FIG. 4 is an exploded view of the mounting assembly.
Figure 5:
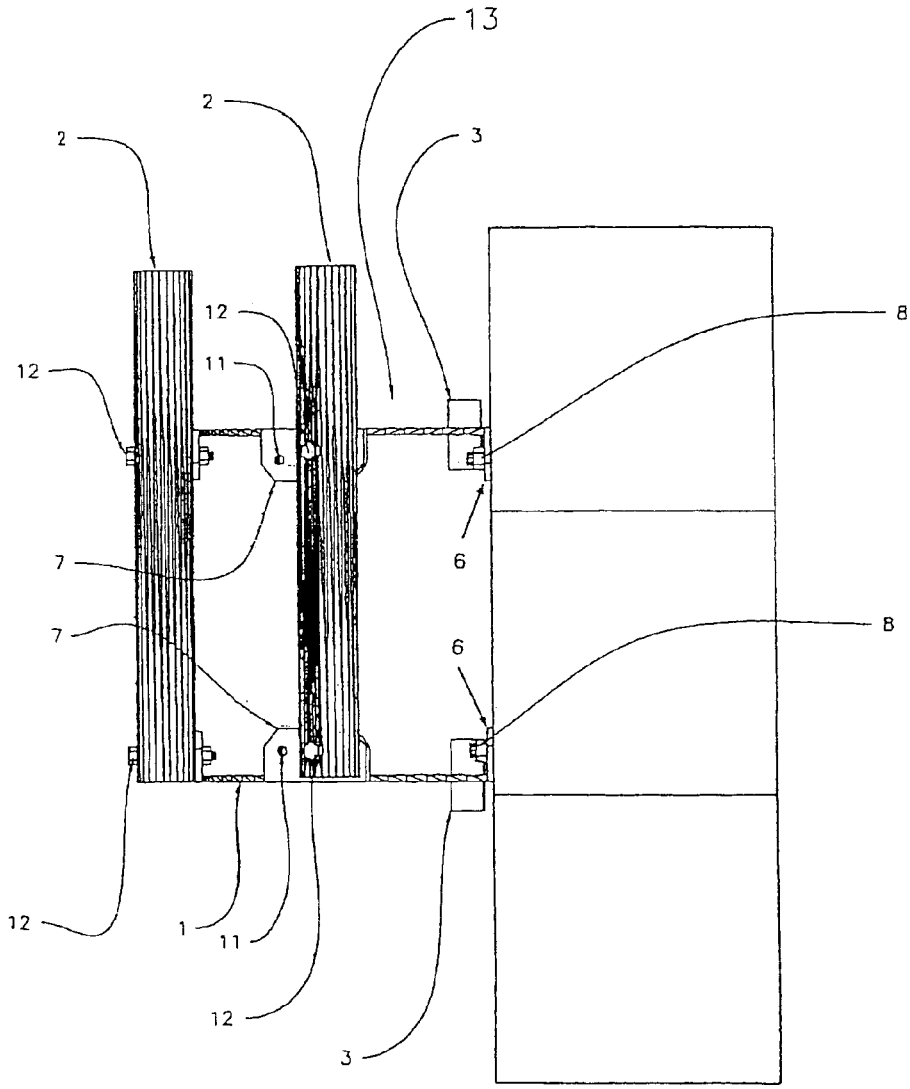
FIG. 5 is a side view of the mounting assembly bolted to a flat wall.
Figure 8:
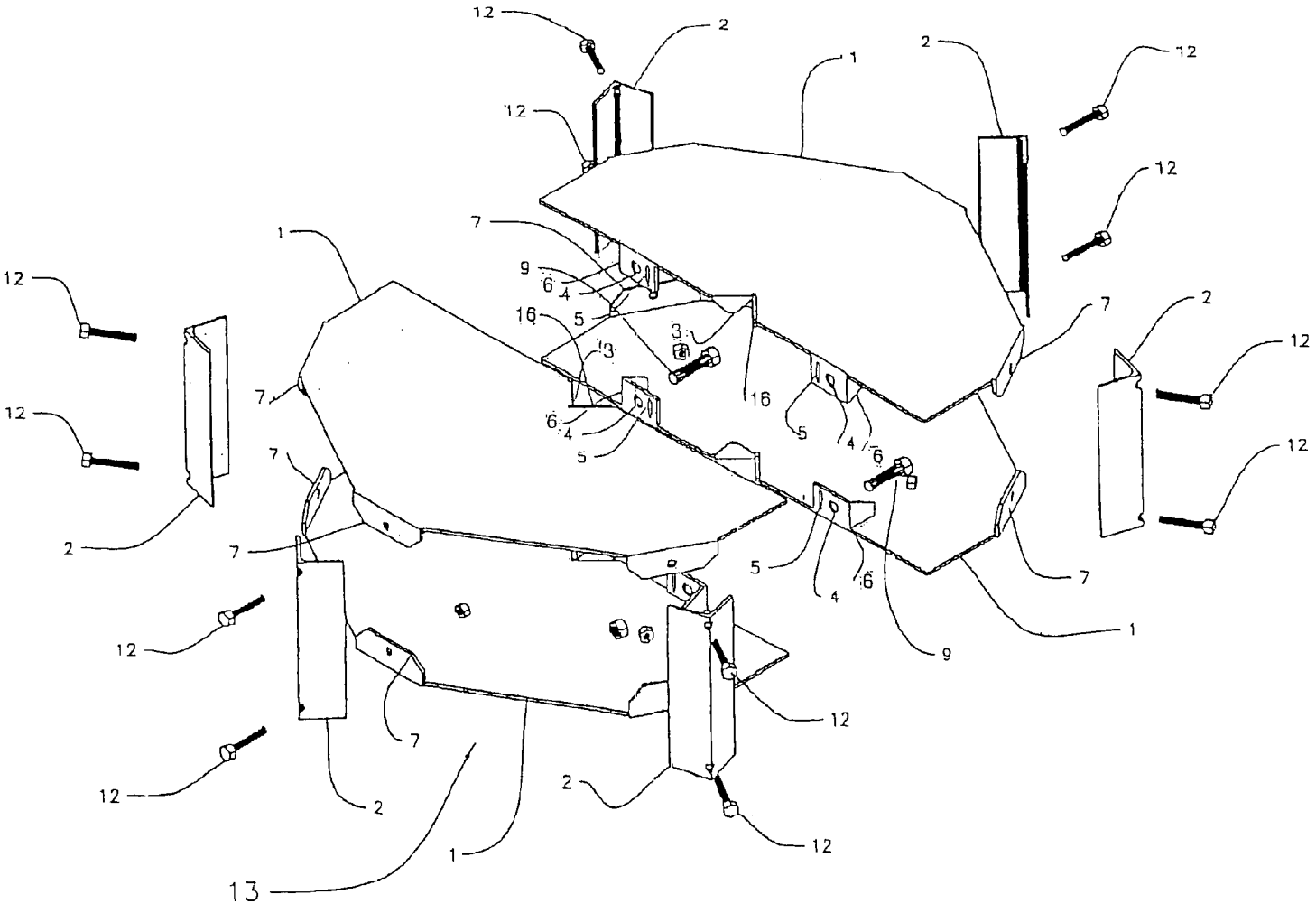
FIG. 8 is an exploded view of a second alternative embodiment of a mounting assembly for sectorized antennas with vertical columns comprising structural angles.

Each mounting tab 6 is a substantially planar surface that is substantially perpendicular to the top surface of horizontal bracket 1, allowing horizontal bracket 1 to be mounted flush to a flat wall, as seen in FIG. 5. Preferably, the mounting tabs 6 on one side of V-notch 3 are also substantially planar with respect to the mounting tabs 6 on the other side of V-notch 3. Mounting tabs 6 may vary in size. For example, mounting tabs 6 may span the entire distance from the perimeter of horizontal bracket 1 to V-notch 3, as shown in FIGS. 1–4. Alternatively, mounting tabs 6 may only span a small portion of the distance from the perimeter of horizontal bracket 1 to V-notch 3, as shown in FIG. 8. It is contemplated that mounting tabs 6 may vary in size and frequency. Mounting tab 6 may comprise a mounting tab hole 4 and a mounting tab slot 5 on its vertical surface, as seen in FIG. 4.

Figure 2:
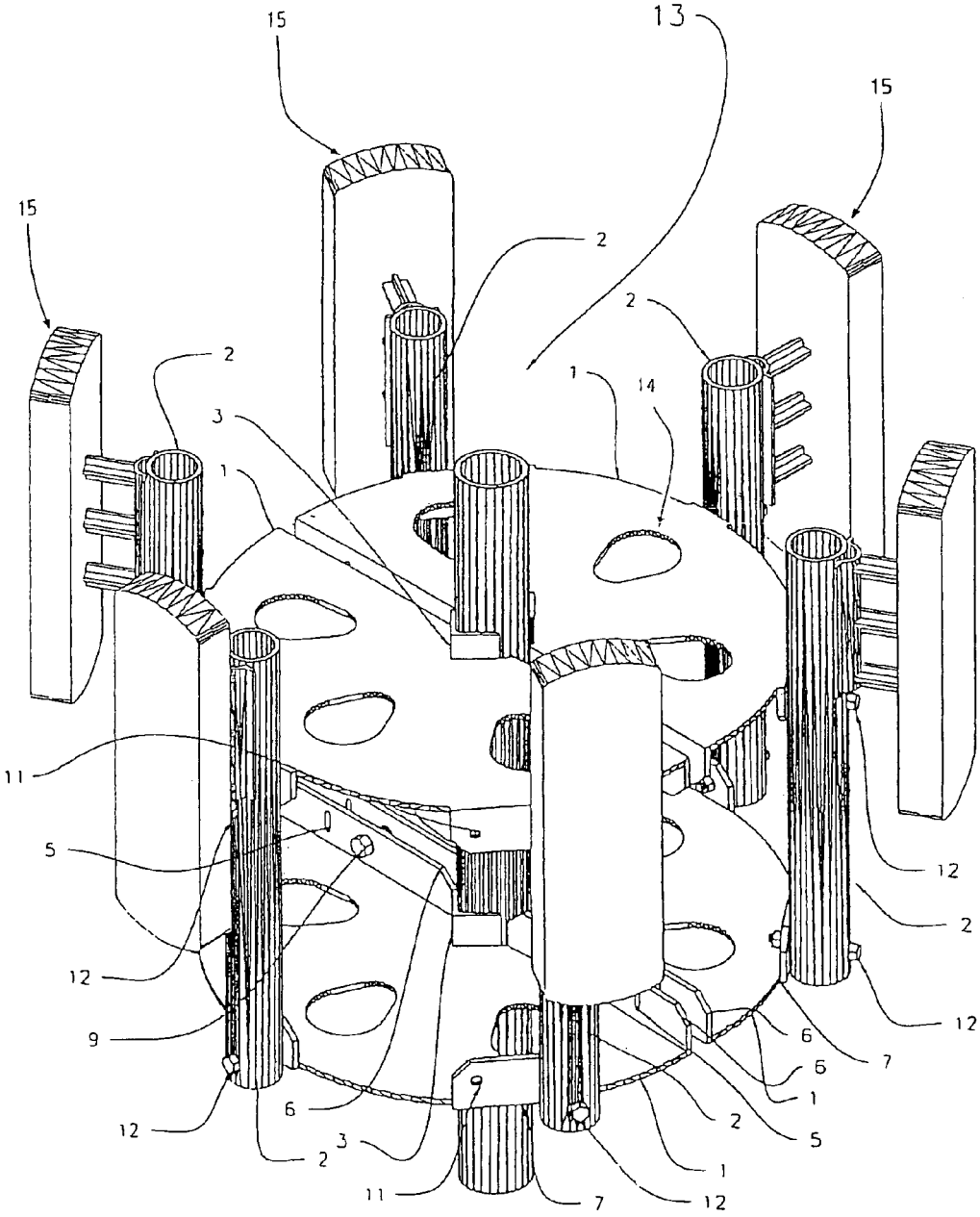
FIG. 2 is an oblique view of the mounting assembly supporting antennas and clamped to a small diameter mast.
Figure 3:
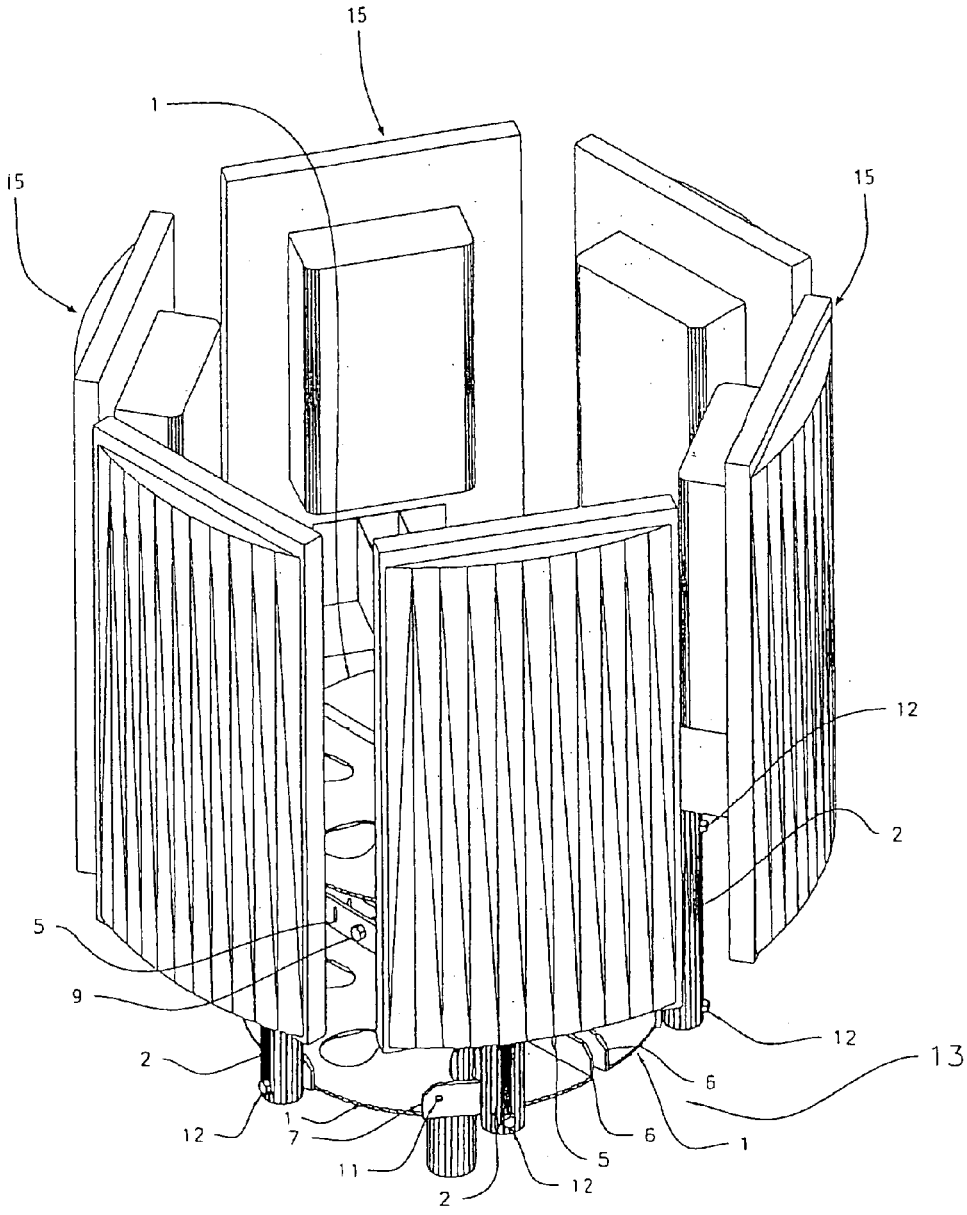
FIG. 3 is another oblique view of the mounting assembly supporting antennas and clamped to a small diameter mast.

Mounting tab hole 4 may be used to secure horizontal brackets 1 to a small diameter mast, utilizing bolts 9 as seen in FIGS. 1–3. Bolts 9 are placed through a mounting tab hole 4 on a horizontal bracket 1, and then through a corresponding mounting tab hole 4 on another horizontal bracket 1 positioned on the opposite side of the small diameter mast. Nuts are then screwed on to bolts 9, thereby securing both horizontal brackets 1 to the small diameter mast.

Mounting tab hole 4 may also be used to secure horizontal bracket 1 to a flat wall, utilizing bolts 8 as seen in FIG. 5. Bolts 8 are placed through mounting tab holes 4 on horizontal bracket 1, and then through the flat wall, thereby securing horizontal bracket 1 to the flat wall.

Figure 6A:
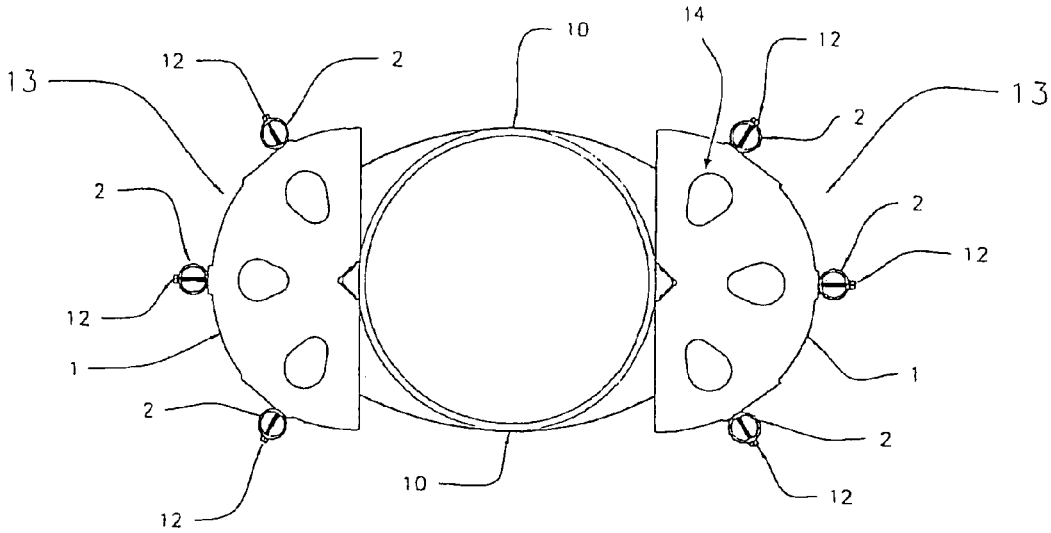
FIG. 6A is a plan view of the mounting assembly banded to a large diameter mast.
Figure 6B:
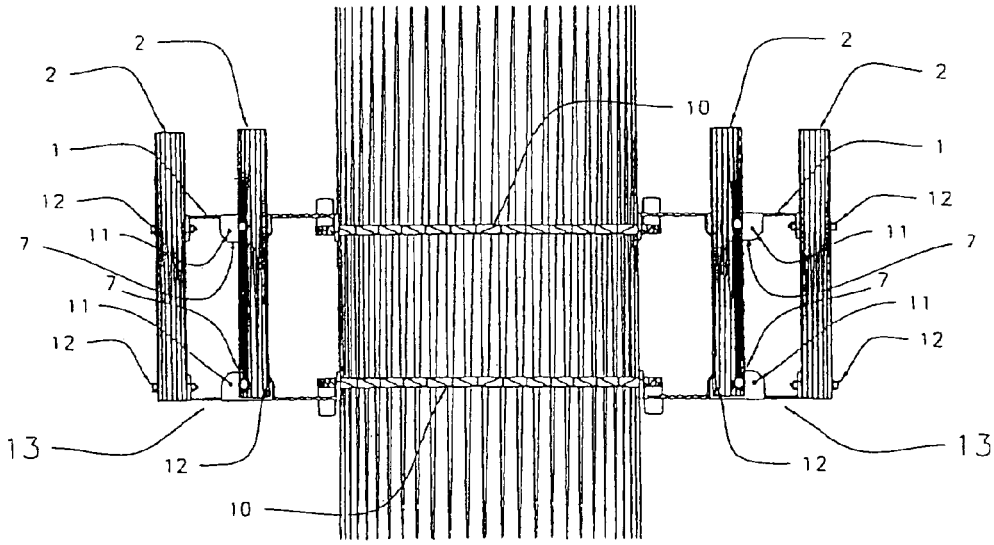
FIG. 6B is a side view of the mounting assembly banded to a large diameter mast.

Mounting tab slots 5 may be used to secure horizontal brackets 1 to a large diameter mast, utilizing band 10 as seen in FIGS. 6A and 6B. Mounting tab slots 5 are configured to accept any standard commercially available banding material sufficient to secure horizontal brackets 1 to a large diameter mast. Band 10 is passed through mounting tab slots 5 on a first horizontal bracket 1, around the large diameter mast, through mounting tab slots 5 on a second horizontal bracket 1 positioned on the opposite side of the large diameter mast, and around the other side of the large diameter mast, back to the first horizontal bracket 1, where band 10 may be tightened, securing horizontal brackets 1 to the large diameter mast.

The outer portion of each horizontal bracket 1 is convex and comprises at least one mounting column support tab 7, providing a vertical surface for securing vertical mounting columns 2 to horizontal bracket 1. Each mounting column support tab 7 comprises a plurality of mounting column support tab holes 11. Vertical mounting column 2 may be non-rotatably secured to horizontal brackets 1 by placing bolts 12 through vertical column 2 and through mounting column support tab holes 11 on mounting column support tab 7. Nuts are then screwed onto bolts 12, thereby securing vertical mounting column 2 to horizontal bracket 1. In this preferred embodiment, vertical mounting columns 2 may not be rotated with respect to horizontal bracket 1 in order to achieve azimuth adjustment. However, vertical mounting columns 2 may be adjusted by changing the mounting column support tab hole 11 to which they are secured.

The outer portion of horizontal brackets 1 is configured to allow for antennas to be mounted over a 180 degree arc when attached to a wall, and a 360 degree rotation for purposes of antenna orientation when secured to a mast. The outer portion of horizontal brackets 1 may comprise a variety of shapes. In FIGS. 1–7, the outer portion defines an arcuate or semi-circular perimeter, spanning approximately 180 degrees. In FIGS. 8–11B, the outer portion of horizontal brackets 1 defines a segmented and angled perimeter, spanning approximately 180 degrees. It is contemplated that a variety of other shapes may be used.

It is also contemplated that mounting column support tabs 7 may be designed and positioned in a variety of ways. They may comprise segmented or arcuate vertical surfaces, in addition to many other designs. Mounting column support tabs 7 may also have spacing that corresponds to the beam width of the intended sectorized antenna. For example, In FIGS. 1–6B, each horizontal bracket 1 comprises three mounting column support tabs 7 that are spaced apart. The number of mounting column support tab holes 11 on each mounting column support tab 7 may vary. In FIGS. 1–6B, each horizontal bracket 1 comprises two mounting column support tabs 7, each having two mounting column support tab holes 11, on opposite sides of a middle mounting column support tab 7 having only one support tab hole 11 (see FIG. 4). The coverage area may be adjusted by repositioning vertical mounting columns 2 in different mounting column support tab holes 11.

Figure 7:
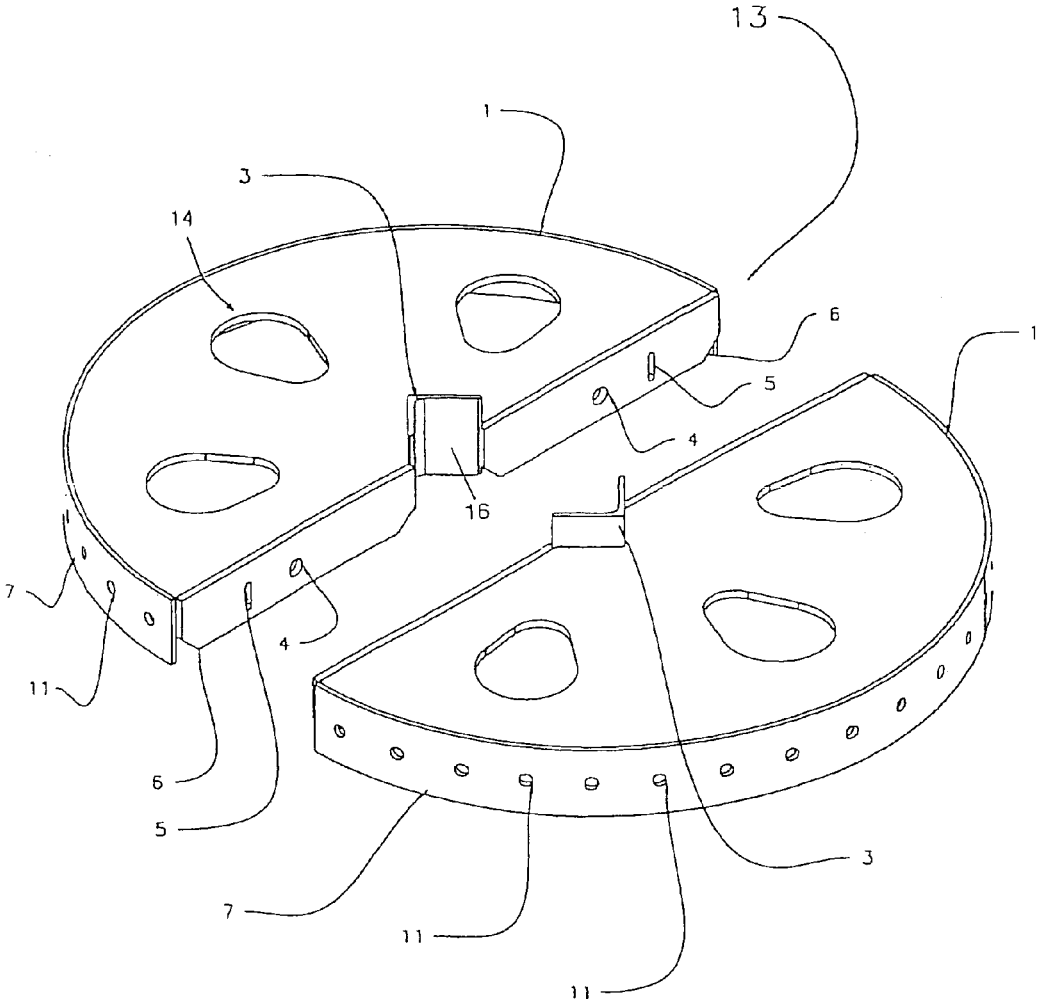
FIG. 7 is an oblique view of an alternative embodiment of a mounting assembly for sectorized antennas.

The horizontal brackets 1 in FIG. 7 each have only one mounting column support tab 7. In this embodiment, the mounting column support tab 7 comprises one long continuous surface spanning the entire outer portion of the horizontal bracket 1. The mounting column support tab 7 comprises a plurality of evenly spaced mounting column support tab holes 11 spanning the entire outer portion of horizontal bracket 1, thereby allowing for a greater variety of vertical mounting column 2 and antenna 15 positioning.

Similar to the horizontal brackets 1 in FIGS. 1–6B, the horizontal brackets 1 in FIGS. 8–11B each comprise three mounting column support tabs 7 that are spaced apart. As shown in FIG. 8, each mounting column support tab 7 comprises only one mounting column support tab hole 11. However, it is contemplated the number of mounting column support tab holes 11 on each mounting column support tab 7 may vary.

Vertical mounting columns 2 may comprise a variety of sizes, materials and structural shapes. Such shapes include, but are not limited to, pipes (such as in FIGS. 1–6B), structural beams, structural angles (such as the v-shaped angles in FIGS. 8–11B), solid squares, hollow squares, solid cylinders, hollow cylinders, tubular shapes, formed sheet metal shapes, and any other shapes that may conform to the mounting requirements of a particular antenna.

In addition to being able to use horizontal brackets 1 in pairs on opposite sides of a mast, or similar support structure, horizontal brackets 1 may also be used as vertical pairs, with one horizontal bracket 1 secured to and supporting the top of vertical columns 2 and one horizontal bracket 1 secured to and supporting the bottom of vertical columns 2. As shown in FIGS. 1, 2, 3, 5, 6B, 9, 10, and 11B, these vertical pairs may be used on any type of support structure, including, but not limited to, masts and flat walls. This two-level configuration provides more support for vertical columns 2 and results in less stress on each mounting column support tab 7. Despite the additional level of horizontal brackets 1, the mounting assembly 13 still maintains a relatively light weight due to its design. In a preferred embodiment, the four horizontal brackets 1, along with the six vertical mounting columns 2, as shown in FIGS. 1–4, 6A, 6B, 8, 9, 11A, and 11B, have a combined weight of less than 30 pounds. Two horizontal brackets 1, along with three vertical mounting columns 2, as shown in FIGS. 5 and 10, may have a combined weight of less than 15 pounds. However, it is contemplated that the combined weight of the horizontal brackets 1 and the vertical mounting columns 2 may vary according to modifications to the design made within the scope of the present invention.

Figure 9:
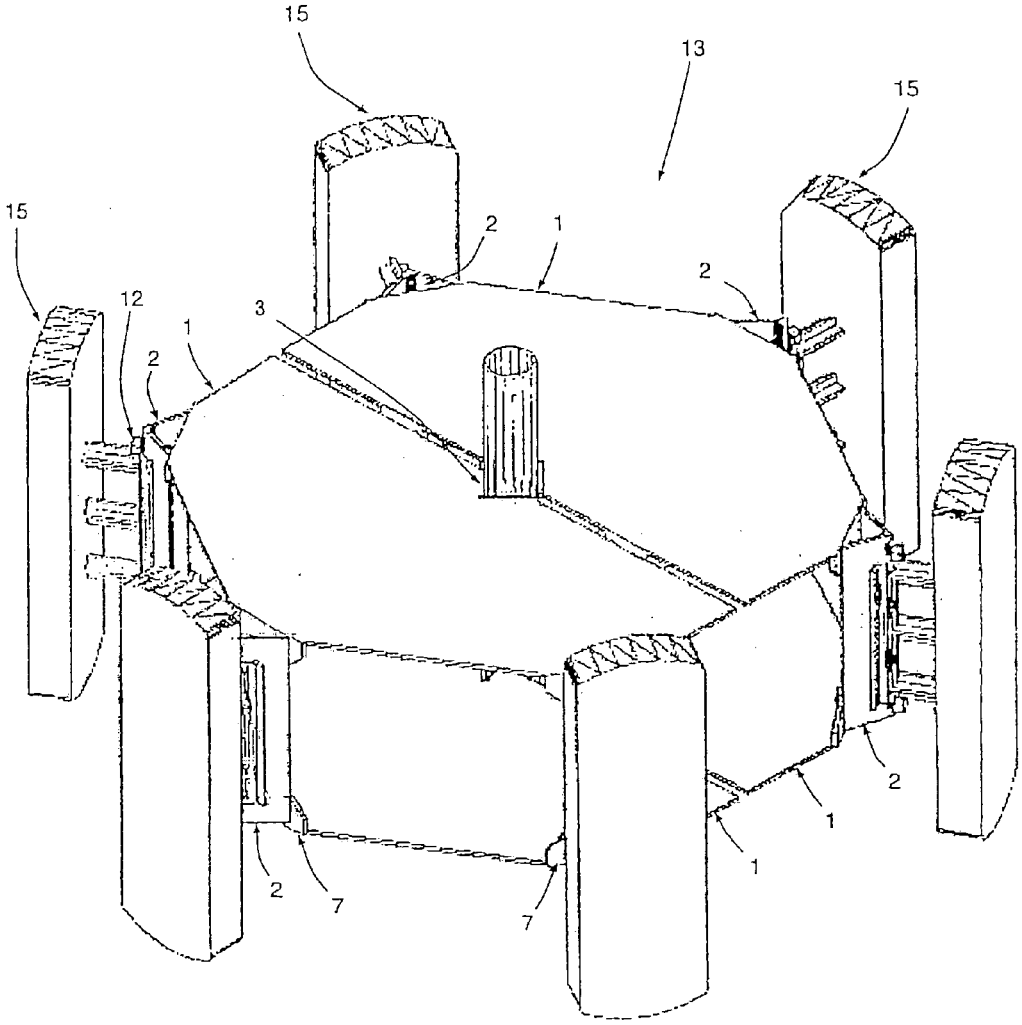
FIG. 9 is an oblique view of the second alternative mounting assembly supporting antennas and clamped to a small diameter mast.
Figure 10:
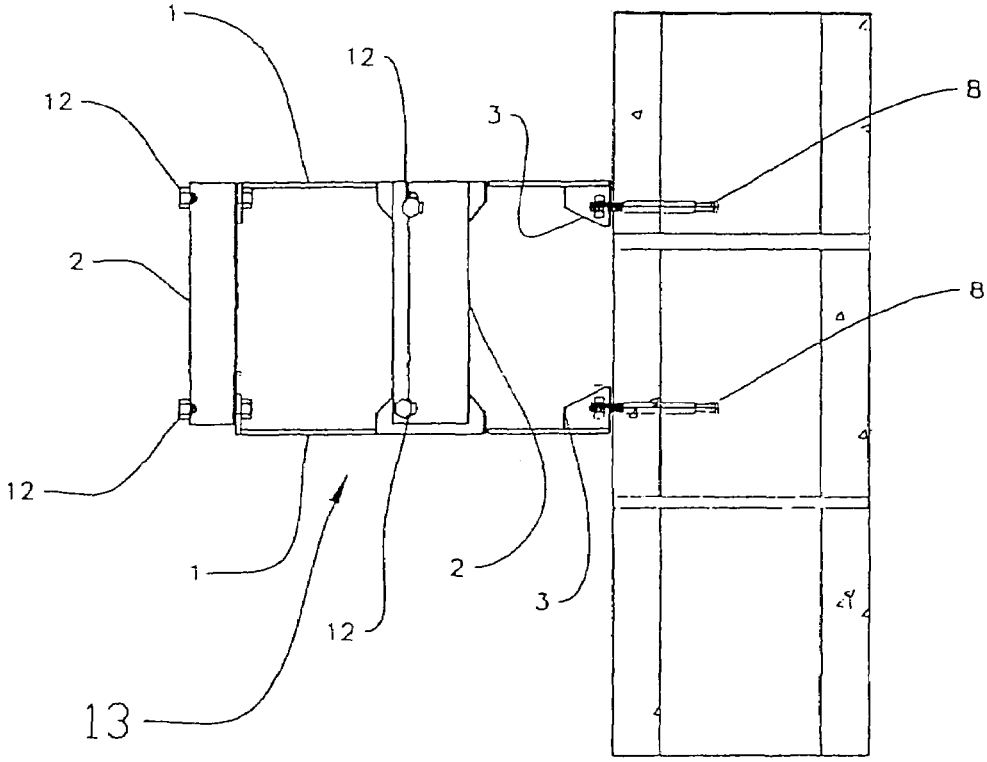
FIG. 10 is a side view of the second alternative mounting assembly bolted to a flat wall.
Figure 11A:
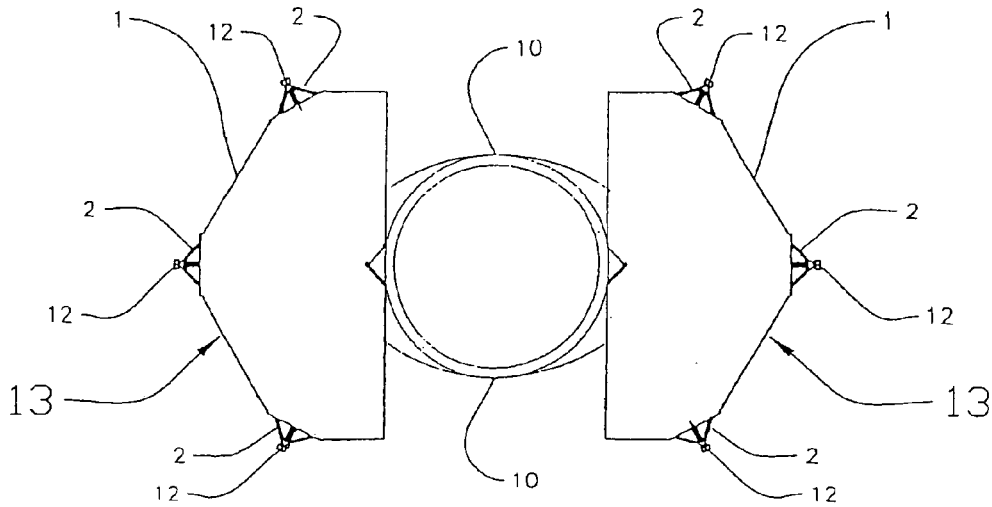
FIG. 11B is a side view of the second alternative mounting assembly banded to a large diameter mast.
Figure 11B:
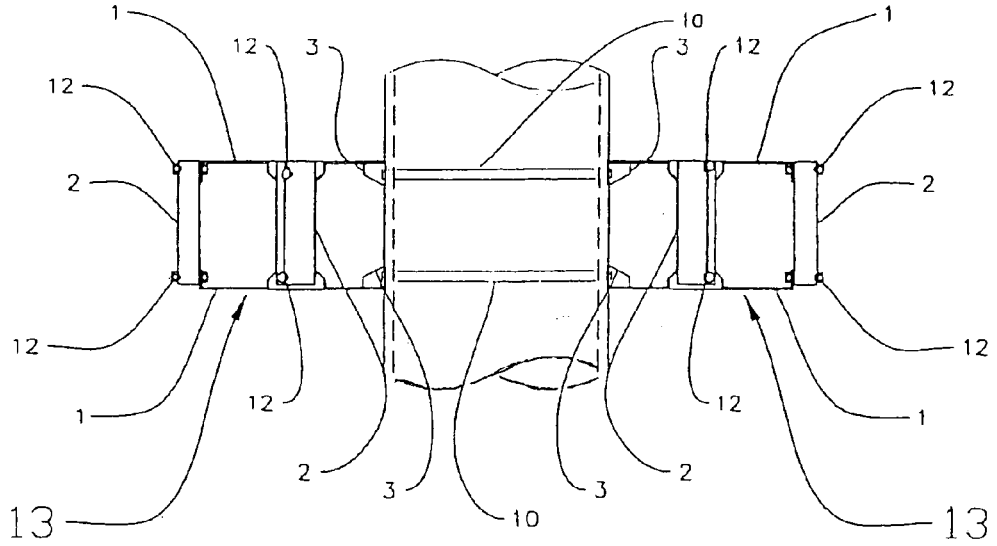

Antennas 15 may be secured to vertical mounting columns 2, as shown in FIGS. 2, 3 and 9. Various types of antennas 15 may be used in accordance with the present invention. It is contemplated that antennas 15 may be secured to vertical mounting columns 2 using a variety of means, including, but not limited to, banding, screws, nuts, and bolts. The quantity and location of vertical mounting columns 2 may be adjusted according to the desired orientation and beam width of antennas 15. For example, if 360 degree coverage is desired with antennas 15 having a 60 degree beam width, six vertical mounting columns 2 would be spaced at 60 degree intervals in order to achieve this result. Various other configurations and adjustments may be used in order to achieve different results.

V-notch 3, mounting tabs 6, engaging tabs 16, and mounting column support tabs 7 may be made integral to horizontal bracket 1, thereby reducing the number of components that need to be manufactured, transported and assembled. Since the mounting assembly 13 has only two dissimilar parts (not including the attachment hardware), the tooling required for mass manufacturing is reduced and the manufacturing process is simplified, thereby reducing the cost of manufacturing. The design of horizontal bracket 1 is such that it can be made from a variety of materials and manufacturing techniques including, but not limited to, casting, molding and forming.

Horizontal brackets 1 also comprise cable openings 14, shown in FIGS. 1–4, 6A, and 7. Cable openings 14 are positioned close to and aligned with vertical mounting columns 2, allowing cables corresponding to a particular antenna 15 to take a more direct and organized route to their corresponding antenna 15. Cable openings 14 also contribute to the light weight of the present invention since the surface area of horizontal bracket 1 is significantly reduced.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A mounting assembly for sectorized antennas, said mounting assembly comprising:

a first plurality of vertical mounting columns, each of said first plurality of vertical mounting columns being configured to support an antenna; and a first horizontal bracket having a top surface and a perimeter, said perimeter being defined by an inner portion configured to be secured to a vertical support structure and an outer portion configured to support said first plurality of vertical mounting columns, wherein said first plurality of vertical mounting columns may not be rotated for azimuth adjustment of said antenna, wherein said inner portion of said first horizontal bracket comprises a V-notch positioned substantially at the center of said inner portion, a first inner vertical surface integral with said first horizontal bracket, and a second inner vertical surface integral with said first horizontal bracket, said first and second inner vertical surfaces being substantially perpendicular to said top surface and positioned on opposite sides of said V-notch, said first and second inner vertical surfaces comprising at least one bolt aperture and at least one banding aperture, and wherein said outer portion of said first horizontal bracket comprises at least one outer vertical surface integral with said first horizontal bracket, said at least one outer vertical surface being substantially perpendicular to said top surface and comprising a plurality of apertures spaced horizontally from one another for supporting and making azimuth adjustments for said first plurality of vertical mounting columns.

2. The mounting assembly of claim 1, wherein each of said first plurality of vertical mounting columns has a top portion and a bottom portion, said mounting assembly further comprising:

a second horizontal bracket having a top surface and a perimeter, said perimeter being defined by an inner portion configured to be secured to a vertical support structure and an outer portion configured to support said first plurality of vertical mounting columns, wherein said first plurality of vertical mounting columns may not be rotated for azimuth adjustment, said inner portion of said second horizontal bracket comprises a V-notch positioned substantially at the center of said inner portion, a first inner vertical surface integral with said second horizontal bracket, and a second inner vertical surface integral with said second horizontal bracket, said first and second inner vertical surfaces being substantially perpendicular to said top surface and positioned on opposite sides of said V-notch, said first and second inner vertical surfaces comprising at least one bolt aperture and at least one banding aperture, said outer portion of said second horizontal bracket comprises at least one outer vertical surface integral with said second horizontal bracket, said at least one outer vertical surface being substantially perpendicular to said top surface of said second horizontal bracket and comprising a plurality of apertures for supporting said first plurality of vertical mounting columns, wherein said top portion of said first plurality of vertical mounting columns is secured to said plurality of apertures of said first horizontal bracket and said bottom portion of said first plurality of vertical mounting columns is secured to said plurality of apertures of said second horizontal bracket.

3. The mounting assembly of claim 2, wherein said first inner vertical surface and said second inner vertical surface of said first horizontal bracket are substantially planar individually and with respect to one another, allowing said first horizontal bracket to be mounted flush against a flat surface, and said first inner vertical surface and said second inner vertical surface of said second horizontal bracket are substantially planar individually and with respect to one another, allowing said second bracket to be mounted flush against said flat surface.

4. The mounting assembly of claim 3, wherein said outer portion of said first horizontal bracket and said outer portion of said second horizontal bracket are convex in shape.

5. The mounting assembly of claim 4, wherein said outer portion of said first horizontal bracket defines an arcuate perimeter and said outer portion of said second horizontal bracket defines an arcuate perimeter.

6. The mounting assembly of claim 4, wherein said outer portion of said first horizontal bracket defines a segmented and angled perimeter and said outer portion of said second horizontal bracket defines a segmented and angled perimeter.

7. The mounting assembly of claim 4, wherein said first horizontal bracket and said second horizontal bracket each comprise a separate aperture for each of said first plurality of vertical mounting columns, each separate aperture being configured to allow for a plurality of cables to pass through.

8. The mounting assembly of claim 4, wherein each of said first plurality of vertical mounting columns comprises a cylindrical shape.

9. The mounting assembly of claim 4, wherein each of said first plurality of vertical mounting columns comprises a V-shaped structural angle.

10. The mounting assembly of claim 4, wherein said first horizontal bracket, said second horizontal bracket and three of said plurality of vertical mounting columns have a combined weight of less than 15 pounds.

11. The mounting assembly of claim 10, wherein said first horizontal bracket and said second horizontal bracket are formed from steel.

12. The mounting assembly of claim 4, wherein said outer portion of said first horizontal bracket and said outer portion of said second horizontal bracket each comprise a first, second and third outer vertical surface integral with said first horizontal bracket and said second horizontal bracket respectively, said first, second and third outer vertical surfaces being substantially perpendicular to said top surface of said first horizontal bracket and said second horizontal bracket, said first, second and third outer vertical surfaces being spaced apart at a substantially equal distance for 180 degree antenna coverage, wherein said first and said second outer vertical surfaces comprising a plurality of apertures spaced horizontally from one another for making azimuth adjustments for said first plurality of vertical mounting columns, and said third outer vertical surface positioned between said first and said second outer vertical surfaces and comprising at least one aperture.

13. The mounting assembly of claim 4, wherein said top portion and said bottom portion of said first plurality of vertical mounting columns is secured to said plurality of apertures of said outer portion of said first horizontal bracket and to said plurality of apertures of said outer portion of said second horizontal bracket respectively using either bolts or screws.

14. The mounting assembly of claim 4, wherein said first horizontal bracket and said second horizontal bracket are secured to a mast by placing a banding material through said at least one banding aperture of said first and second inner vertical surfaces of said first and second horizontal brackets, wrapping said banding material around said mast, and tightening said banding material around said mast.

15. The mounting assembly of claim 4, wherein said first horizontal bracket and said second horizontal bracket are secured to said vertical support structure by placing bolts through said at least one bolt aperture of said first and said second inner vertical surfaces and through said support structure.

16. The mounting assembly of claim 4, further comprising:

a second plurality of vertical mounting columns, each of said second plurality of vertical mounting columns being configured to support an antenna and comprising a top portion and a bottom portion;

a third horizontal bracket; and a fourth horizontal bracket, wherein said third horizontal bracket and said fourth horizontal bracket each have a top surface and a perimeter, said perimeter of said third and fourth horizontal brackets being defined by an inner portion configured to be secured to a vertical support structure and an outer portion configured to support said second plurality of vertical mounting columns, wherein said second plurality of vertical mounting columns may not be rotated for azimuth adjustment of said antenna, said inner portion of said third and said fourth horizontal bracket comprises a V-notch positioned substantially at the center of said inner portion, a first inner vertical surface integral with said third and fourth horizontal bracket respectively, and a second inner vertical surface integral with said second and said third horizontal bracket respectively, said first and second inner vertical surfaces being substantially perpendicular to said top surface and positioned on opposite sides of said V-notch, said first and second inner vertical surfaces comprising at least one bolt aperture and at least one banding aperture, said outer portion of said third and said fourth horizontal bracket comprises at least one outer vertical surface integral with said third and said fourth horizontal bracket respectively, said at least one outer vertical surface being substantially perpendicular to said top surface of said third and said fourth horizontal bracket respectively and comprising a plurality of apertures for supporting said second plurality of vertical mounting columns, wherein said top portion of said second plurality of vertical mounting columns is secured to said plurality of apertures of said third horizontal bracket and said bottom portion of said first plurality of vertical mounting columns is secured to said plurality of apertures of said fourth horizontal bracket, and wherein said first horizontal bracket is secured to said third horizontal bracket, and said second horizontal bracket is secured to said fourth horizontal bracket.

17. The mounting assembly of claim 16, wherein said first horizontal bracket is secured to said third horizontal bracket by placing a bolt through said at least one bolt aperture of said first and said second inner vertical surfaces of said first horizontal bracket and said third horizontal bracket, and by placing a bolt through said at least one aperture of said first and said second inner vertical surfaces of said second horizontal bracket and said fourth horizontal bracket.

18. The mounting assembly of claim 16, wherein said first horizontal bracket is secured to said third horizontal bracket by placing a first banding material through said at least one banding aperture of said first and said second inner vertical surfaces of said first horizontal bracket and said third horizontal bracket, and by placing a second banding material through said at least one aperture of said first and said second inner vertical surfaces of said second horizontal bracket and said fourth horizontal bracket, wherein said first banding material and said second banding material are tightened around said vertical support structure, securing said first horizontal bracket, said second horizontal bracket, said third horizontal bracket, and said fourth horizontal bracket to said vertical support structure.

19. The mounting assembly of claim 4, wherein said V-notch of first horizontal bracket and said second horizontal bracket comprises two substantially planar vertical surfaces that are substantially perpendicular to said top surface of said first horizontal bracket and said second horizontal bracket, said two substantially planar surfaces forming a V-shape.

20. The mounting assembly of claim 4, wherein said first inner vertical surface of said first horizontal bracket extends substantially the entire distance from said V-notch of said first horizontal bracket to said perimeter of said first horizontal bracket, and said second inner vertical surface of said first horizontal bracket extends substantially the entire distance from said V-notch of said first horizontal bracket to said perimeter of said first horizontal bracket.

* * * * *